US009132327B1

(12) United States Patent
Roberts

(10) Patent No.: US 9,132,327 B1
(45) Date of Patent: Sep. 15, 2015

(54) BASKETBALL HOOP WITH BACKBOARD SHATTER SIMULATION

(71) Applicant: James A. Roberts, Coral Springs, FL (US)

(72) Inventor: James A. Roberts, Coral Springs, FL (US)

( * ) Notice: Subject to any disclaimer, the term of this patent is extended or adjusted under 35 U.S.C. 154(b) by 262 days.

(21) Appl. No.: 13/803,202

(22) Filed: Mar. 14, 2013

Related U.S. Application Data

(60) Provisional application No. 61/610,784, filed on Mar. 14, 2012.

(51) Int. Cl.
*A63B 63/08* (2006.01)

(52) U.S. Cl.
CPC ..... *A63B 63/083* (2013.01)

(58) Field of Classification Search
CPC ..... A63B 43/005; A63B 63/083
USPC ..... 473/481; 273/247; 248/583; D21/480
See application file for complete search history.

(56) References Cited

U.S. PATENT DOCUMENTS

| | | | | |
|---|---|---|---|---|
| 1,506,979 | A * | 9/1924 | Foulks | 434/150 |
| 2,199,499 | A * | 5/1940 | Kreitler | 273/273 |
| 2,517,463 | A * | 8/1950 | Cobb | 473/481 |
| D357,518 | S | 4/1995 | Hansberry | |
| 5,842,941 | A | 12/1998 | Siminski et al. | |
| 6,824,481 | B1 * | 11/2004 | Nye et al. | 473/481 |
| 2002/0140168 | A1 * | 10/2002 | Liu | 273/157 R |
| 2010/0304903 | A1 * | 12/2010 | Quinn | 473/487 |

OTHER PUBLICATIONS

Webpage download, Amazon2007, 2007, www.amazon.com/Ryans-Room-U-S-A-Map-Puzzle/dp/B00000ITOQ, 2 pages.*

* cited by examiner

*Primary Examiner* — Gene Kim
*Assistant Examiner* — M Chambers
(74) *Attorney, Agent, or Firm* — Glenn E. Gold; Gold & Rizvi, P.A.

(57) ABSTRACT

The present invention provides a basketball hoop including a frame having a cavity for releasably holding a plurality of backboard pieces therein to form a planar backboard, a basketball hoop pivotally attached to the frame, and a projector assembly coupled to the basketball hoop. When a slam-dunk force is applied to the basketball hoop, the force rotates the hoop downward, causing a projector to pivotally swing forward. The projector applies an ejection force to a rear surface of the plurality of backboard pieces ejecting the backboard pieces from the cavity of the frame, simulating a shattering backboard caused by a slam-dunk. The backboard pieces are preferably fabricated of a safety material, such as foam, rubber, and the like. The arrangement pattern of the backboard pieces may be applied upon the frame to aid in reassembly thereof.

19 Claims, 10 Drawing Sheets

BASKETBALL HOOP WITH BACKBOARD SHATTER SIMULATION

CROSS-REFERENCE TO RELATED APPLICATION

This Non-Provisional Utility application claims the benefit of U.S. Provisional Patent Application Ser. No. 61/610,784, filed on Mar. 14, 2012, which is incorporated herein in its entirety.

FIELD OF THE INVENTION

The present disclosure relates generally to sporting goods. More particularly, the present disclosure relates to a basketball hoop including a hoop mounted to a frame having a cavity for holding a plurality of pieces assembled together as a puzzle forming a planar backboard where the plurality of backboard pieces are projected outwards from the cavity to emulate a backboard shattering during a slam dunk.

BACKGROUND OF THE INVENTION

Basketball has become a very popular sport played by amateurs and professionals alike. The sport is often broadcasted on local and national television and is played by professional national basketball association teams, collegiate teams, and regional schools. Amateurs often play basketball in residential driveways, at local recreational centers, at parks, and the like. The game of basketball is typically played on a playing surface identified as a basketball court and two basketball hoops are positioned at opposite ends of the basketball court and situated a predetermined height from the court. The playing surface may include identifiers, such as circles, arcs, and a variety of straight and curved lines, to define the playing boundaries prescribed by game rules. Teams compete against each other in an effort to score the most points by throwing a basketball through the opponent's basketball hoop.

Conventional basketball hoops include a round metal rim or hoop attached to a backboard. A netting material is suspended downward from the hoop, and the hoop is securely positioned about the lower, horizontally centered region of the backboard. The backboard is often constructed from glass, Plexiglas, or a hard thick plastic material. The diameter of the basketball hoop is larger than a basketball to allow the ball to pass easily through the hoop during play. There are a variety of different basketball hoops on the market today. Some configurations include brackets designed to permanently attach the basketball hoop to a substantially vertical surface, such as a garage, while others include columns, adjustable frames or telescoping beams that provide mobility in moving and placing the basketball hoops in different locations if desired.

One crowd-pleasing play that is often seen during the game of basketball is what is coined "a slam dunk". A slam-dunk occurs when a player jumps through the air and forces the ball downward through the hoop with one or both hands. On occasion, the player is often seen applying a downward force on the rim of the hoop or holding onto the rim of the hoop for a split second. In rare circumstances, the downward force applied to the hoop during a slam-dunk causes the backboard to shatter resulting in the backboard glass shattering. Needless to say, the experience not only provokes the spectator's attention, but also provides an uplifting adrenaline rush engulfing the audience's attention to the game. The dramatic sights and sounds of the event instill a heightened level of interest in replicating the shattering backboard event. As such, basketball enthusiasts' desire to simulate the shattering of a basketball backboard.

What is desired is a basketball hoop that is designed to emulate the shattering of a backboard during a slam dunk of a ball through the hoop, is safe to use by children, is easy to assemble, and requires little effort in puzzling together backboard pieces for repeated use.

SUMMARY OF THE INVENTION

The basic inventive concept provides a basketball hoop system that provides a safe, easy to use, and entertaining device for a child or adult to play basketball while experiencing the simulating effects of a basketball backboard shattering into pieces when performing a slam dunk.

In one aspect of the invention, a basketball hoop is provided, comprising a frame having a cavity extending inward from a front plane of the frame;

a plurality of backboard pieces detachably fitted together as a puzzle and releasably inserted within the cavity;

a projector assembly including:

a support plate carried by one of the frame and the rear panel, a hoop supporting member pivotally assembled to the support plate a bias member, and a projector, the projector being pivotally carried by the frame, wherein the projector pivots between a staged configuration wherein the projector is positioned within the cavity behind the plurality of backboard pieces when the plurality of pieces are releasably inserted within the cavity and a deployed configuration wherein the projector rotates forward ejecting the plurality of backboard pieces; and a hoop assembly including a circular hoop and netting suspended from the circular hoop, the hoop assembly being carried by the hoop supporting member positioning the circular hoop in a generally perpendicular relation with the frame, wherein the circular hoop is in operational communication with the projector, wherein the biasing member retains the projector in the staged configuration and wherein, when the circular hoop is drawn downward, the downward motion is communicated to the projector, causing the projector to rotate forward ejecting the plurality of backboard pieces.

In yet another aspect of the invention, each of the plurality of backboard pieces is fabricated of a soft pliant material.

In yet another aspect of the invention, each of the plurality of backboard pieces is fabricated of soft injection molded foam.

In another aspect of the invention, each of the plurality of backboard pieces comprises indicia disposed upon a surface of each of the plurality of backboard pieces, wherein the indicia provides an aid in the placement of the plurality of backboard pieces within the frame cavity.

In yet another aspect of the invention, the rear panel further comprises a front surface, wherein the rear panel front surface is visibly exposed when the plurality of backboard pieces are removed from the cavity; and an outline of each of the plurality of backboard pieces is disposed upon the front surface, wherein the outline provides an aid in the placement of the plurality of backboard pieces within the frame cavity.

In another aspect of the invention, the bias member is a coil spring, having one portion coupled to the hoop supporting member and a second portion coupled to the support plate.

In another aspect of the invention, the projector is configured to contact a majority of the plurality of backboard pieces when the plurality of pieces are releasably positioned within the cavity.

In another aspect of the invention, the projector is a bar extending bilaterally from a central area of the frame, the projector defining a wing-shaped frame configured to extend behind the plurality of backboard pieces when the plurality of pieces are releasably fitted within the cavity.

In another aspect of the invention, the projector is a planar sheet of material having a size and shape to engage with a majority of the plurality of pieces when the plurality of pieces are releasably positioned within the cavity.

In yet another aspect of the invention, at least a portion of the plurality of backboard pieces further comprising a friction increasing material disposed on at least a portion of a peripheral edge, wherein the friction increasing material has a coefficient of friction that is greater than a surface of a peripheral edge of the backboard piece, the friction increasing material enhances a friction fit between each of the plurality of pieces.

In another aspect of the invention, there is disclosed a basketball hoop system comprising:

a frame having a cavity extending inward from a front plane;

a plurality of backboard pieces detachably fitted together as a puzzle and releasably fitted within the cavity;

a projector assembly comprising:

a hoop supporting member attached to the hoop, a support plate attached to a rear panel of the frame, wherein the support plate is parallel to the rear panel and perpendicular to the hoop, a bias member coupled to the hoop supporting member and support plate, and a projector pivotally coupled to the bias member, wherein the projector is disposed within the cavity behind the plurality of backboard pieces when the plurality of pieces are releasably fitted within the cavity; and a hoop assembly including a circular hoop and netting suspended from the hoop, the hoop assembly being carried by the hoop supporting member positioning the circular hoop in a generally perpendicular relation with the frame.

In yet another aspect of the invention, the basketball hoop system further comprises a downward configuration, wherein the hoop is at an obtuse angle relative to the backboard and the projector is at an acute angle relative to the backboard, and an upright configuration, wherein the hoop is perpendicular to the backboard and the projector is parallel with the backboard.

In yet another aspect of the invention, there is provided a pair of inverted U-shaped brackets mounted proximate to each of a top corner of the frame defining an adequate space for hanging the basketball hoop on a top edge of a door.

In another aspect of the invention, the bias member is a coil spring having one portion coupled to the hoop supporting member and a second portion coupled to the support plate.

In another aspect of the invention, a front surface of the rear panel comprises an outline of each of the plurality of backboard pieces, the front surface being the front face of the rear panel that is visibly exposed when the plurality of backboard pieces are not within the cavity.

In another aspect of the invention, there is provided a basketball hoop comprising:

a frame having a cavity extending inward from a front plane;

a plurality of backboard pieces detachably fitted together as a puzzle and releasably fitted within the cavity;

a projector assembly comprising:

a hoop supporting member attached to the hoop, a support plate attached to a rear panel of the frame, wherein the support plate is parallel to the rear panel and perpendicular to the hoop, a bias member coupled to the hoop supporting member and support plate, and a projector pivotally coupled to the bias member, wherein the projector is disposed within the cavity behind the plurality of backboard pieces when the plurality of pieces are releasably fitted within the cavity;

a hoop assembly including a circular hoop and netting suspended from the hoop, the hoop assembly being carried by the hoop supporting member positioning the circular hoop in a generally perpendicular relation with the frame; and a gap between the projector and a rear surface of the plurality of background pieces when the plurality of pieces are releasably fitted within the cavity.

In another aspect of the invention, there is provided a pair of inverted U-shaped brackets mounted proximate to each of a top corner of the frame defining an adequate space for hanging the basketball hoop on a top edge of a door.

In another aspect of the invention, the bias member is a coil spring having one portion coupled to the hoop supporting member and a second portion coupled to the support plate.

In another aspect of the invention, the projector is a bar extending bilaterally from a central area of the frame, the projector defining a wing-shaped frame configured to extend behind the plurality of backboard pieces when the plurality of pieces are releasably fitted within the cavity.

In another aspect of the invention, the front surface of the rear panel comprises an outline of each of the plurality of backboard pieces, the front surface being the front face of the rear panel that is visibly exposed when the plurality of backboard pieces are not within the cavity.

These and other advantages of the present invention will be further understood and appreciated by those skilled in the art by reference to the following written specifications, claims and appended drawings.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
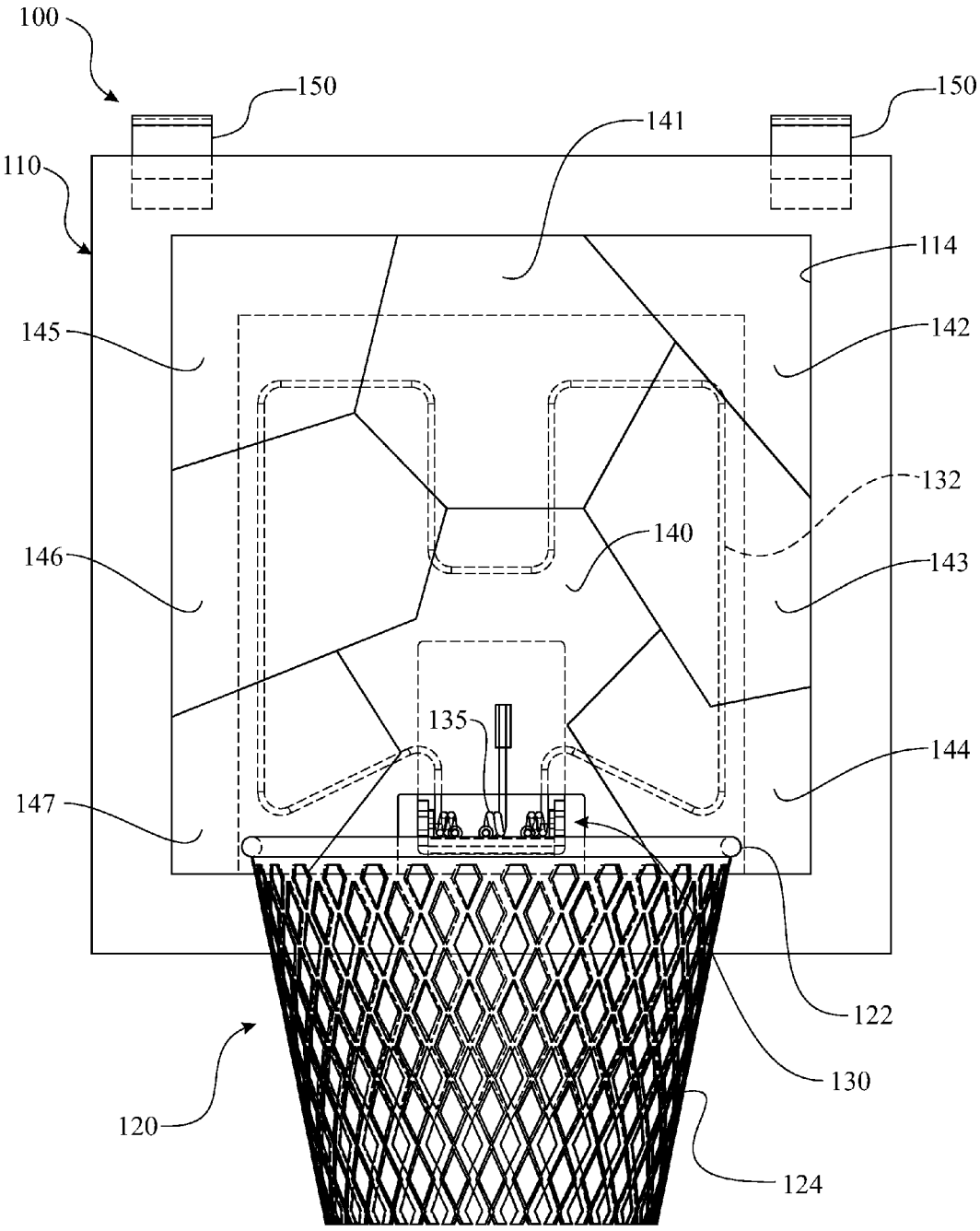
FIG. 1 presents a front view of an exemplary basketball hoop having a plurality of pieces puzzled together to form a planar backboard.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof, shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

An exemplary basketball hoop device 100 is illustrated if FIGS. 1 through 4. The basketball hoop device 100 includes a generally, square frame 110, a hoop assembly 120 pivotally attached to the frame 110, and a plurality of backboard pieces 140-147 that are releasably disposed within a cavity 114. The frame 110 is constructed from a rigid, durable material such as plastic, wood, hard rubber, a composite material (such as fiberglass, Kevlar, and the like), or a padded metal (such as a lightweight aluminum, steel, and the like). The frame 110 includes a border disposed around the frame 110, and a rear panel 116 that together define a cavity 114 having a predetermined depth for releasably holding a plurality of backboard pieces 140-147 that are inter-fitted together like a puzzle to form a planar, backboard of the basketball hoop device 100. It is understood that although the present invention shows a generally square, frame 110, other geometric shapes may be contemplated such as round, oval or rectangular.

Figure 2:
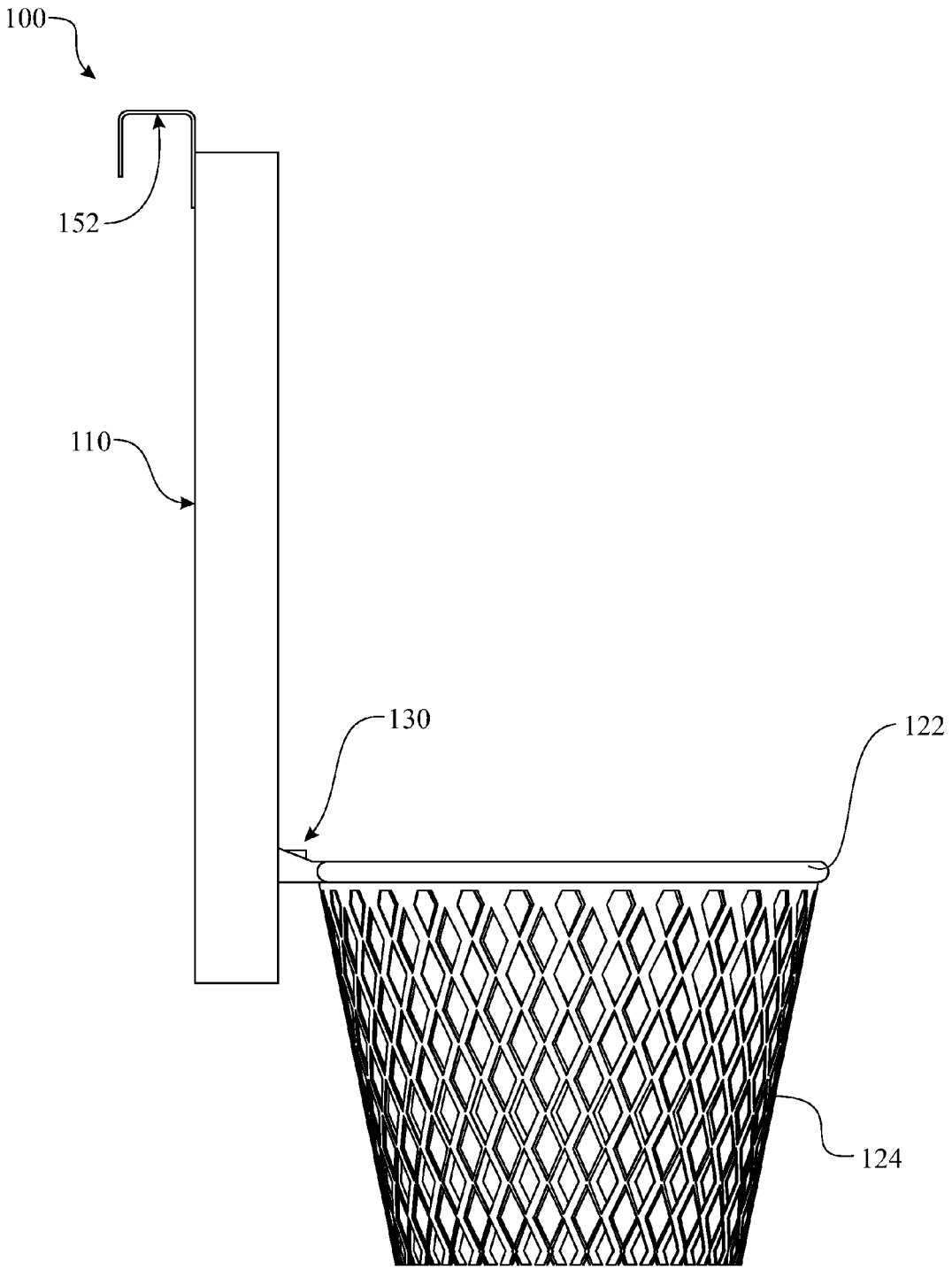
FIG. 2 presents a side view of the basketball hoop introduced in FIG. 1.
Figure 3:
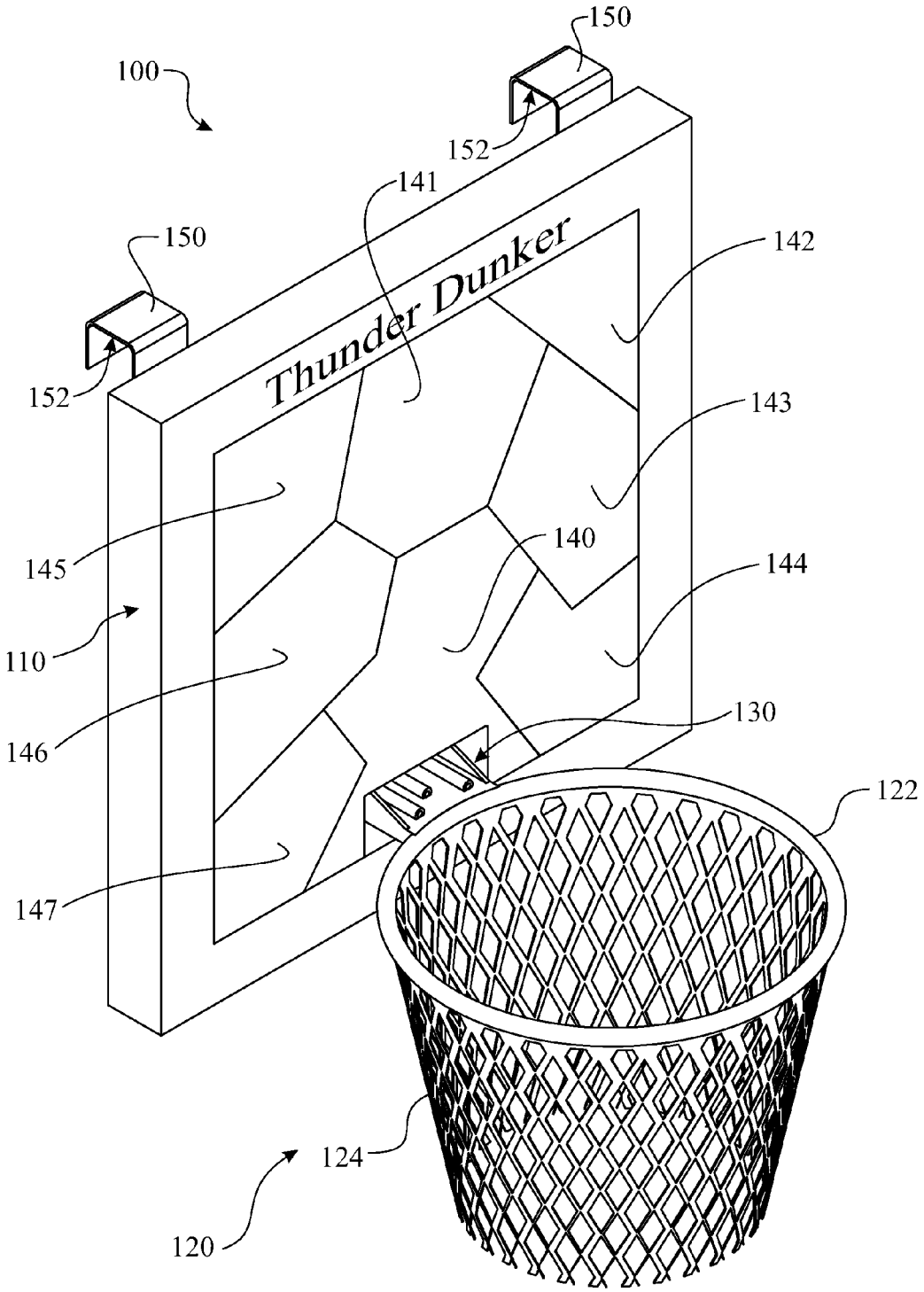
FIG. 3 presents a perspective view of the basketball hoop introduced in FIG. 1.

The basketball hoop 100 can include exemplary mounting brackets 150, as best illustrated in FIGS. 2 and 3. The mounting brackets 150 are secured to the frame 110 at a location proximate to each of the top corners of frame 110. In the exemplary embodiment, each bracket 150 is formed having an inverted U-shape configuration defining an adequate space 152 for hanging the basketball hoop device 100 on a top edge of a door. It would be understood by those skilled in the art that other mounting brackets may include other suitable fasteners used to secure the basketball hoop 100 on a horizontal or vertical surface as well. For example, other suitable fasteners may include any of nuts and bolts, clamps, magnets, plates and screws, hooks, suction cups, a dense hook and loop tape, or any other mechanical component. Alternatively, the basketball hoop 100 may include a vertically, adjustable stand or telescoping beam frame attached to a base to provide mobile movement of the hoop device 100. The basketball hoop 100 may be attached to other supports and stands that are well known in the art.

Figure 8:
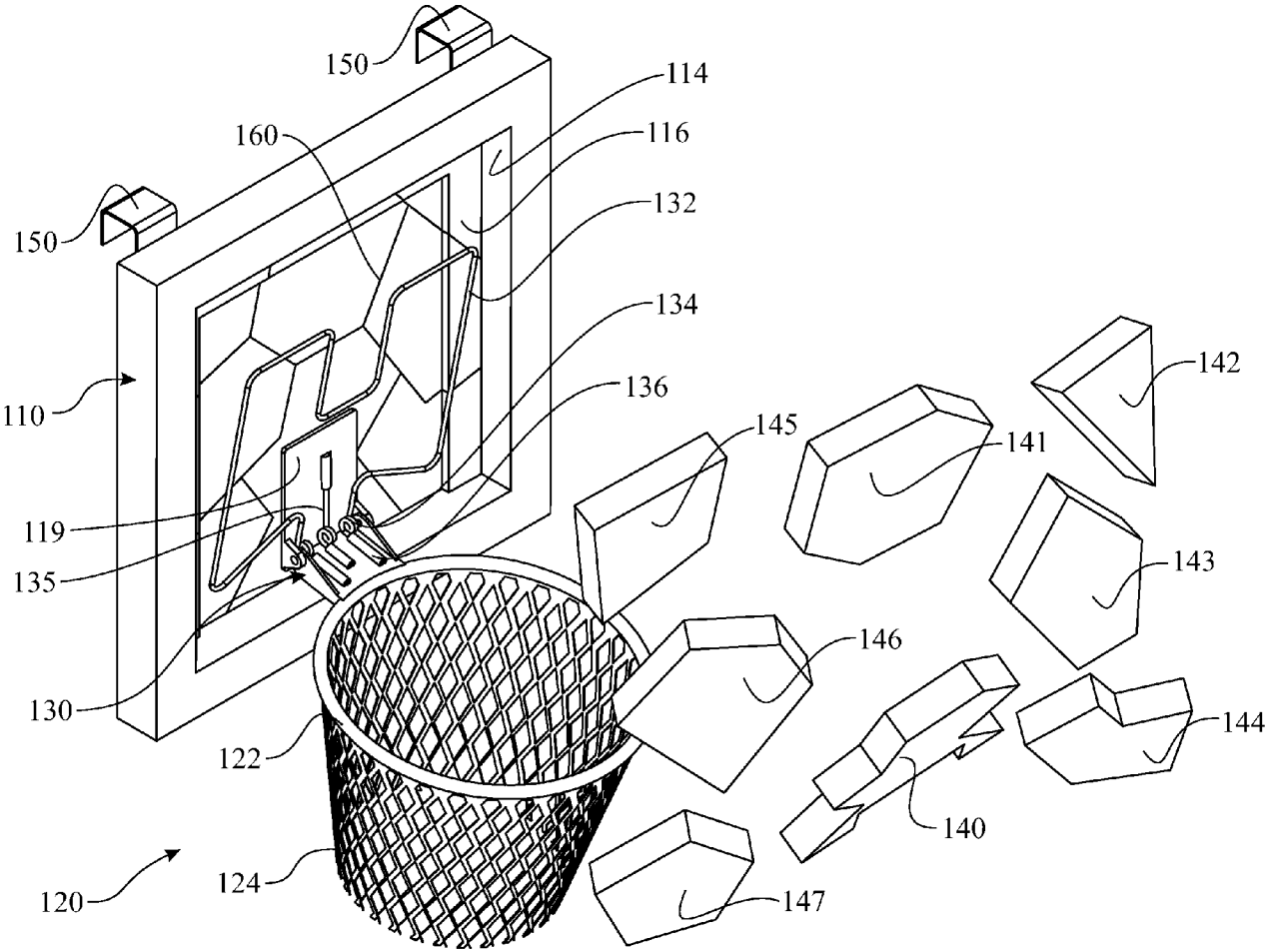
FIG. 8 presents an isometric view of the basketball hoop in a condition as previously illustrated in FIG. 5, showing initiation of the plurality of backboard pieces being projected outward to simulate a shattering of the backboard.

Each backboard piece 140-147 may include the same or different geometrical shape. For example, to emulate the appearance of jagged pieces of glass, as when a real basketball backboard shatters, each piece 140-147 preferably includes a different geometrical shape and size, having irregular contour edges. Thus, pieces 140-147 may comprise triangles, hexagons, and pentagons shapes just to name a few. Pieces 140-147 are fitted or assembled together like a puzzle within the cavity 114. The assembled puzzle provides a planar, basketball backboard. With safety in mind, each piece 140-147 is preferably constructed from a soft foam material. Though other materials are contemplated for use as pieces 140-147, such as rubber, plastic or wood, the foam material does not pose a risk of danger to children during use. The thickness of each backboard piece 140-147 will correspond to the depth of the cavity 114. For example, a cavity 114 having a smaller depth requires backboard pieces 140-147 that are thinner. To enhance the aesthetic appearance of the basketball hoop 100, each backboard piece 140-147 may comprise the same or different color, and may also include markings, characters, symbols, or any other indicia printed or adhered thereon, if desired. In one non-limiting example, each backboard piece 140-147 may be numbered or include a letter to assist a child in assembling the pieces 140-147 together (see FIG. 9). In the preferred embodiment, the dimensional outline 160 of each piece is depicted on the rear panel 116 of the frame 110, as illustrated in FIG. 8. In this manner, a player (such as a child) can simply place each backboard piece 140-147 to the corresponding shape as outlined on rear panel 116. The backboard pieces 140-147 should be dimensionally constructed to provide friction fitting such that, when assembled together, the backboard pieces 140-147 having friction fitting allows the backboard pieces 140-147 to remain together without dislodging or falling as a result of gravity and/or slight movement. It is understood that a material can be applied to the mating sides, such as portions of the peripheral edges, of each of the backboard pieces 140-147 that has a coefficient of friction greater than that applied to non-mating sides of each of the backboard pieces 140-147.

As shown, the basketball hoop 100 further includes a hoop assembly 120 including a hoop 122, mesh or netting 124 material suspended from the hoop 122, and a projecting assembly 130. In one non-limiting example, the circular hoop 122 is dimensioned to allow a ball to pass through with ease. Different types of balls may be used for play such as rubber balls, foam balls, plastic balls, and the like. The circular hoop 122 may be constructed from a durable material that is able to withstand repeated impact forces as a result of a ball impacting the hoop or due to forces exerted thereon by a person. The netting 124 is constructed from the well-known materials such as cotton, vinyl, or plastic. Alternatively, the netting 124 may be fabricated of a single formed section of plastic lattice that is designed to mimic the features of a real net. The netting 124 can be permanently attached to, or removably detached from, the hoop 122.

Figure 4:
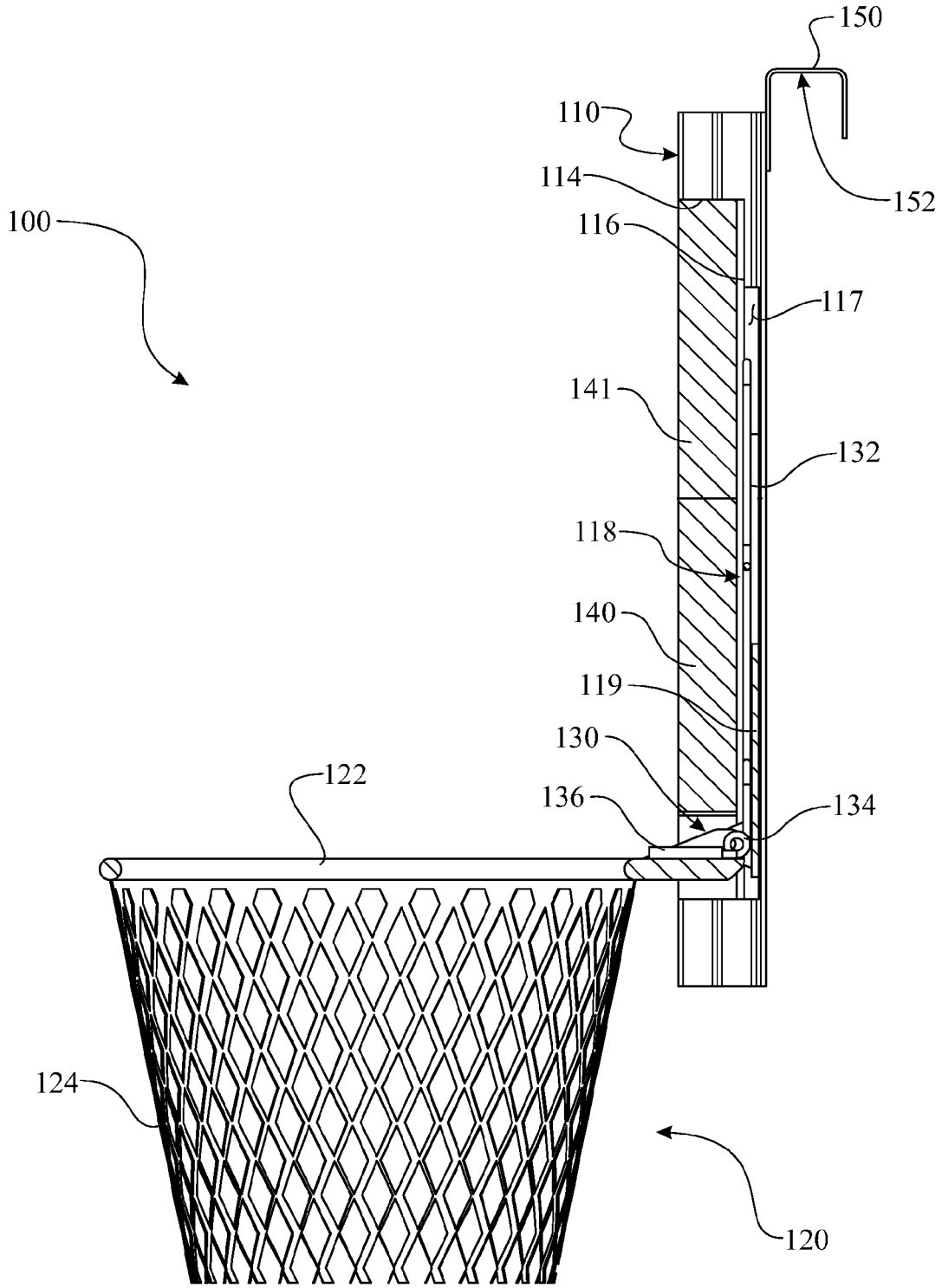
FIG. 4 presents a partially sectioned side view of the basketball hoop introduced in FIG. 1, introducing a projector and the plurality of backboard pieces assembled together within a frame.
Figure 5:
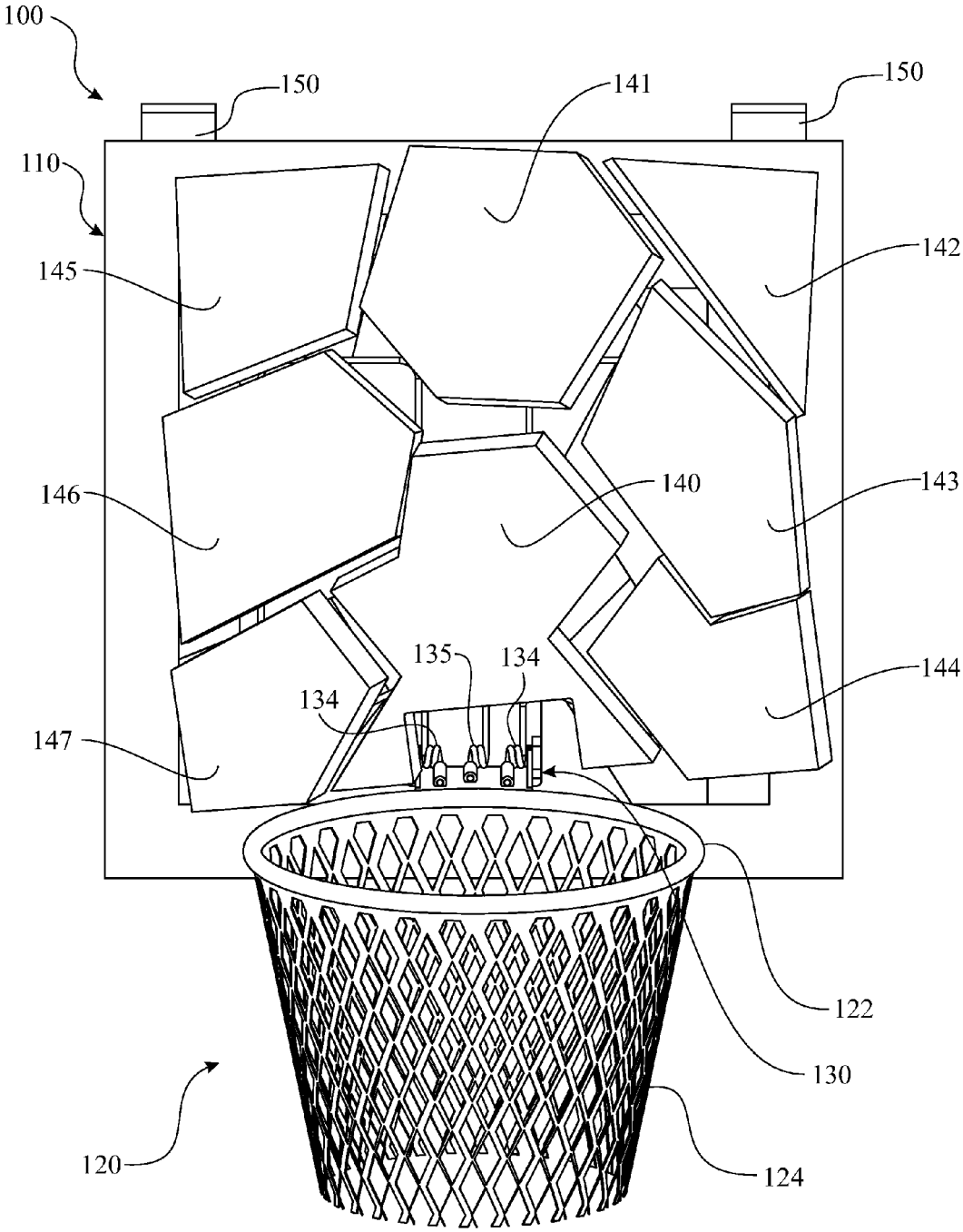
FIG. 5 presents a front view of the basketball hoop introduced in FIG. 1, showing the dislodgement of the plurality of backboard pieces as a result from a slam dunk.
Figure 9:
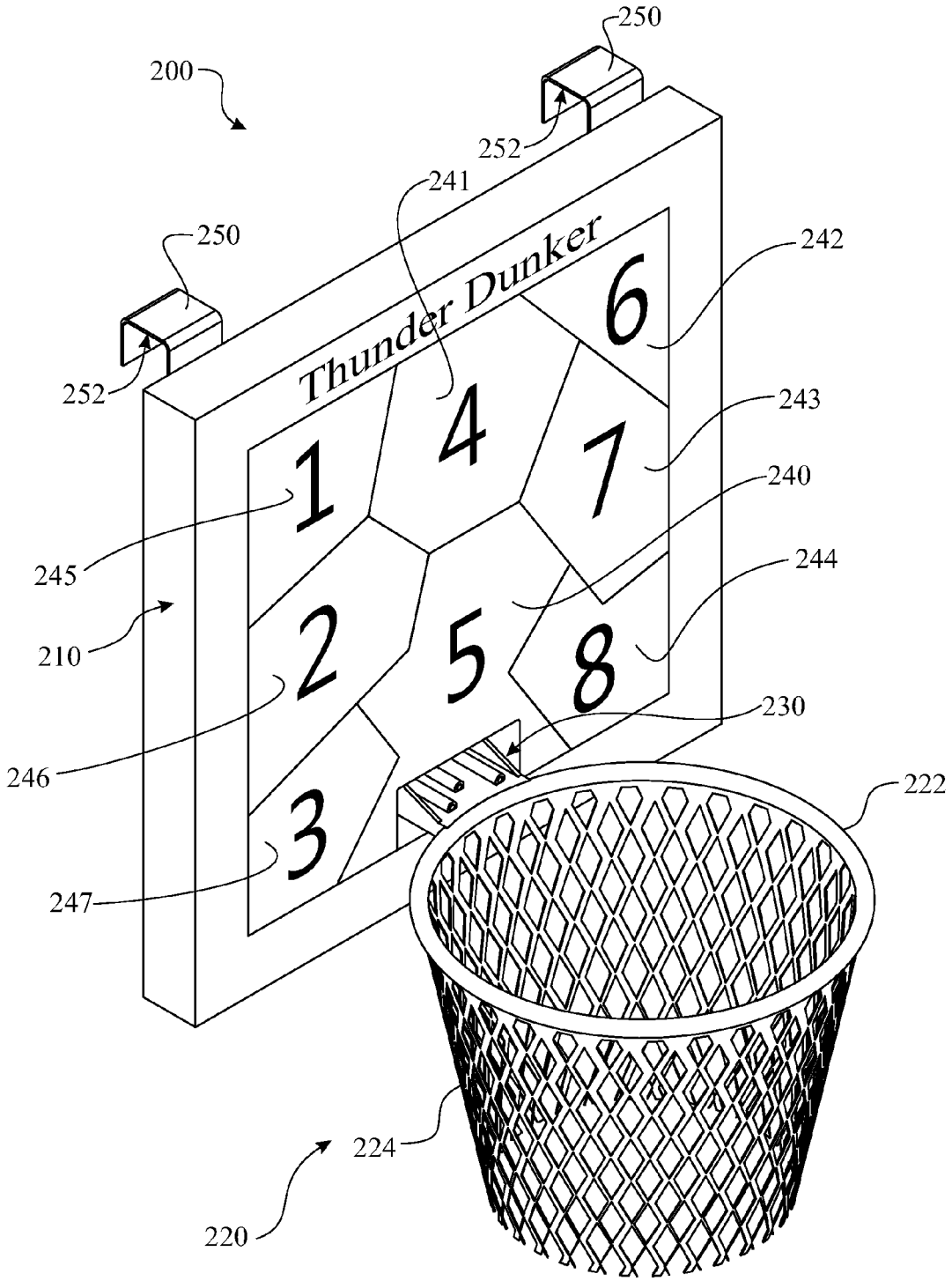
FIG. 9 presents an alternative embodiment of the basketball hoop in a perspective view, introducing an exemplary set of backboard pieces comprising indicia printed on the surface of each piece.
Figure 10:
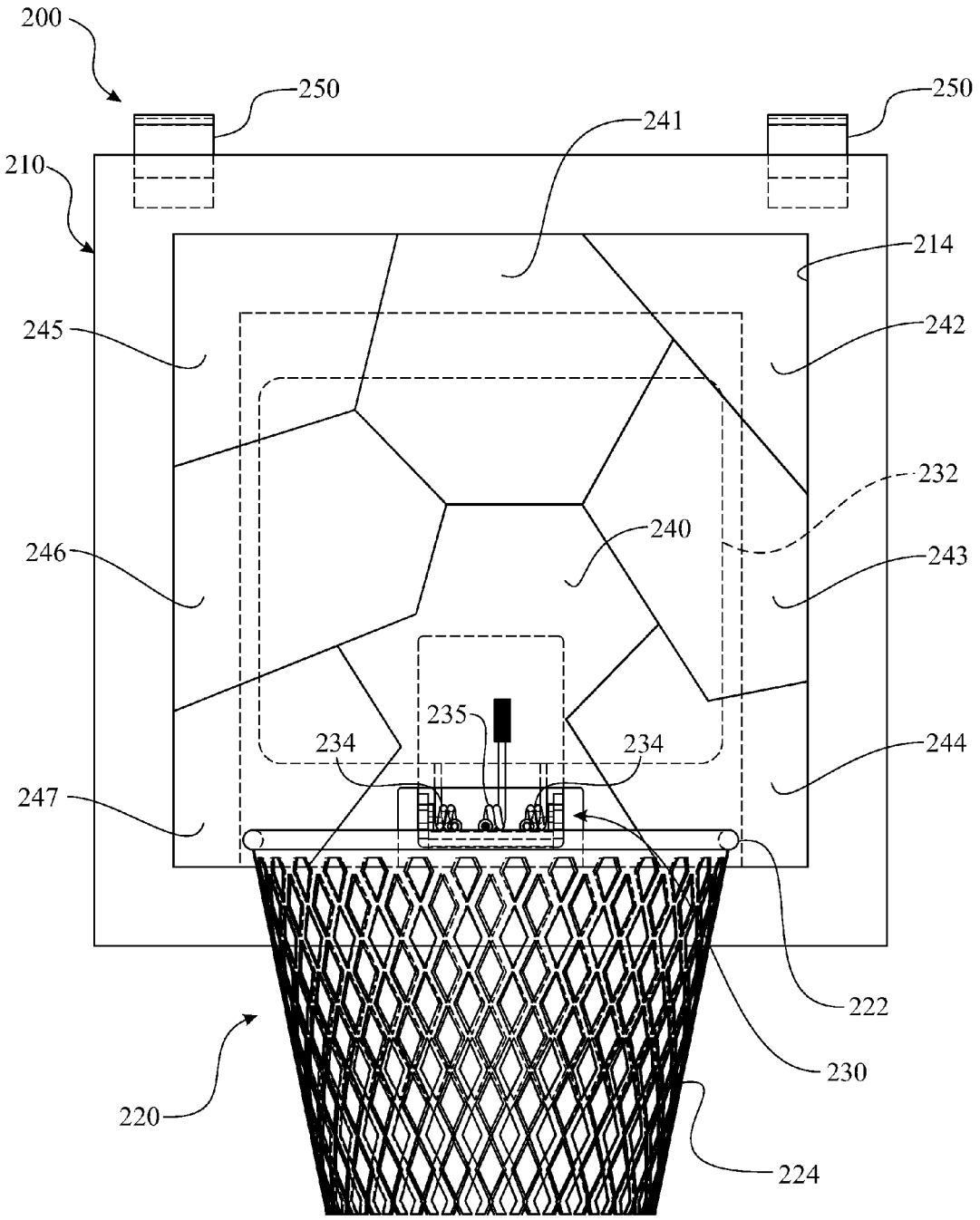
FIG. 10 presents an alternative embodiment of the basketball hoop in a front view, introducing an exemplary projector shaped as a flat rectangular plate.

As illustrated in FIGS. 1 and 4, the projecting assembly 130 is operatively attached to the frame 110. The projecting assembly 130 includes a support plate 119 attached to the rear panel 116 of frame 110 and disposed in a recess 117 formed in the rear panel 116 at the rear of and in communication with the cavity 114, a hoop plate 136 attached to the hoop 122 and pivotally attached to the support plate 119, a pair of spaced apart coil springs or spring mechanisms of a first bias member 134 coupled to the hoop plate 136, a second bias member 135, such as a coil spring or spring mechanism, coupled to the support plate 119 and the hoop plate 136, disposed between and spaced from the spring mechanisms of the first bias member 134 and configured to bias the hoop plate 136, and the hoop 122 therewith, to an upright position relative to the frame 110 (illustrated in FIGS. 1-4), and a projector 132 being provided in the form of an elongated member coupled to the hoop plate 136, via its attachment to the coil springs or spring mechanisms of the first bias member 134, and substantially disposed at a staged configuration in the recess 117 at the rear of the cavity 114 wherein the elongated member 132 is positioned separate from and unattached to the plurality of backboard pieces 140-147 and extends between the rear panel 116 and the plurality of backboard pieces, behind a majority of the plurality of backboard pieces. In one embodiment, as illustrated in FIG. 1, the elongated member of the projector 132 takes the form of a meandering hollow or solid bar with lateral butterfly wing-shaped portions. In another embodiment, as illustrated in FIG. 10, the elongated member of the projector 232 takes the form of a flat metal or plastic plate that spans slightly less than the width and height of the cavity 214, having a uniform thickness and being in the general shape of the frame 210. (It should be understood that like features of the basketball hoop device 100 in FIGS. 1-8 and 200 in FIGS. 9 and 10 are numbered the same except preceded by the numeral '2" in FIGS. 9 and 10.) It is understood that the elongated member in the form of the butterfly wing-shaped projector 132 and plate projector 232 are merely exemplary embodiments and that the projector 132, 232 may be in any shape that is separated from and unattached to the plurality of backboard pieces 140-147 and positioned between the majority of the plurality of backboard pieces 140-147 (when the backboard pieces 140-147 are inserted into the cavity 114) and the rear panel 116, while being coupled to the hoop plate 136 via the first bias member 134 such that when force is applied to the hoop 122, the projector 132, 232 pivots with the hoop plate 136 to a deployed configuration where it is able to dislodge the pieces 140-147. When a momentary downward force is applied to the hoop 122, the hoop 122 swings, together with the hoop plate 136 and thus against the bias of the second bias member 135, relative to the support plate 119 from the upright position (illustrated in FIG. 4) to a downward position, wherein the hoop 122 is at an obtuse angle relative to the plane of the backboard (illustrated in FIG. 6). When the momentary downward force is released from the hoop 122, it swings back to the upright position, wherein the hoop 122 is perpendicular to the plane of the backboard (illustrated in FIG. 4). As the hoop 122 swings downwardly, the coil spring or spring mechanism of the second bias member 135 is stretched, allowing the hoop 122 to swing from the upright position into the downward position. However, the second bias member 135 is configured to resist the stretching, therefore, shortly after obtaining the downward position and upon the release of the application of the momentary downward force on the hoop 122, the reactive force of the second bias member 135 causes the hoop 122, and the hoop plate 136 therewith, to pivot relative to the support plate 119 back into the upright position. Concurrently, as the hoop 122 swings from the upright position into the downward sloping position, the projector 132 pivots away from the rear panel 116 of the frame 110 due to its coupling via the first bias member 134 with the hoop plate 136. As a result, the force of the projector 132 moving forward and downwardly away from the rear panel 116 dislodges the puzzle pieces 140-147 from the cavity 114 and projects them 140-147 forward away from the cavity 114. Gravity causes the puzzle pieces 140-147 to fall, thereby emulating the "shattering" of a basketball hoop backboard, as illustrated in FIG. 6.

As illustrated in FIG. 4, a gap 118 is implemented between the rear surfaces of the plurality of background pieces 140-147 and the projector 132, the latter being substantially disposed in the recess 117 formed in the rear panel 116 in communication with the rear of the cavity 114. The gap 118 permits the hoop 122 to move slightly downwards, and thus the projector 132 slightly forwards, without necessarily causing the projector 132 to dislodge the plurality of backboard pieces 140-147. Thus, the hoop 122 has some leeway in pivoting downwards momentarily and the projector 132 in pivoting forwards without dislodging the foam backboard pieces 140-147. The gap 118 prevents a user from having to setup the backboard pieces 140-147 every single time a ball comes in contact with the hoop 122. Thus, the projector 132 dislodges the backboard pieces 140-147 only upon receiving a sufficient amount of force.

Figure 6:
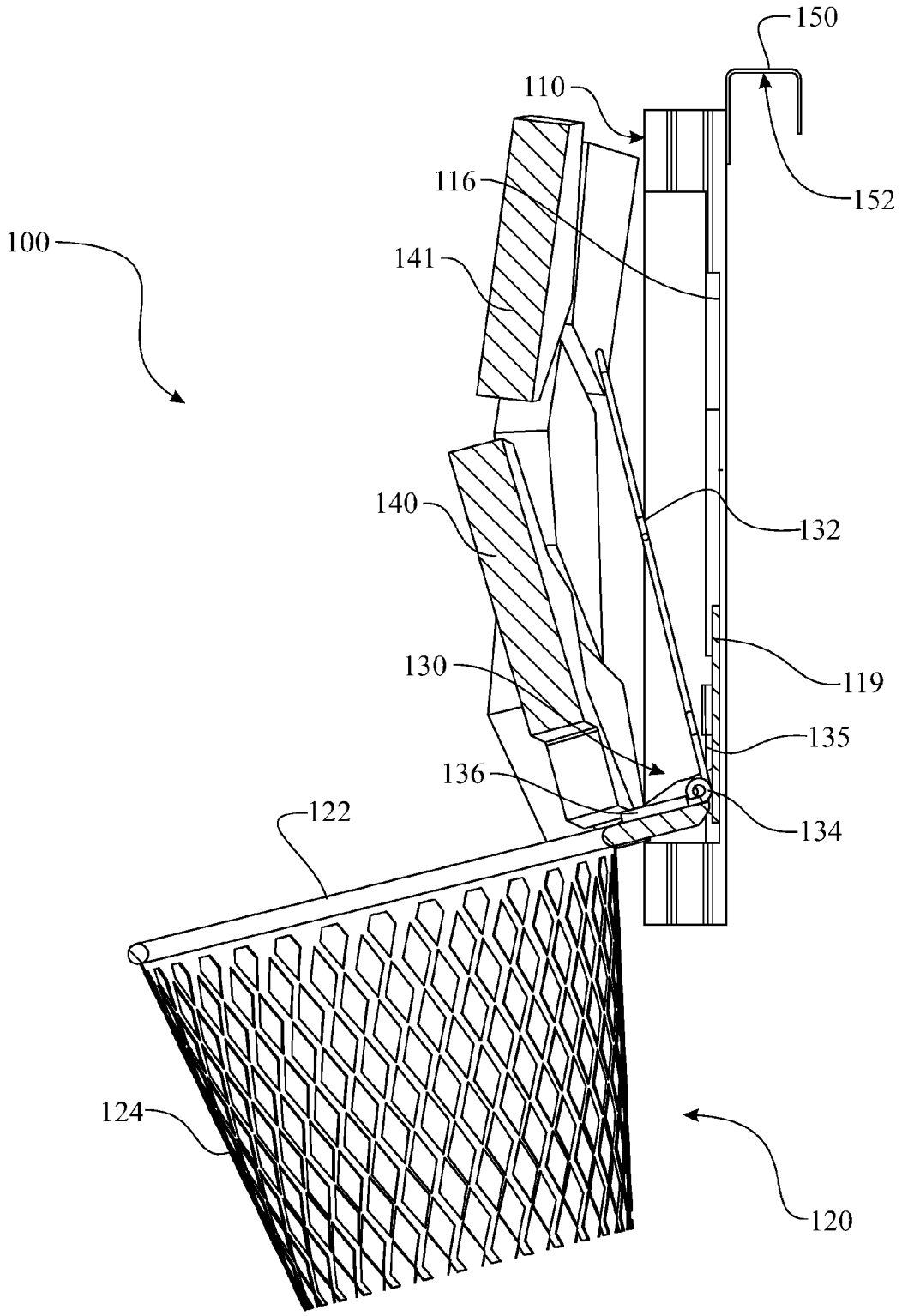
FIG. 6 presents a partially sectioned side view of the basketball hoop in a condition as previously illustrated in FIG. 5, showing the projector dislodging the plurality of backboard pieces to emulate the shattering of the backboard when a prescribed dunking force is applied to the hoop.
Figure 7:
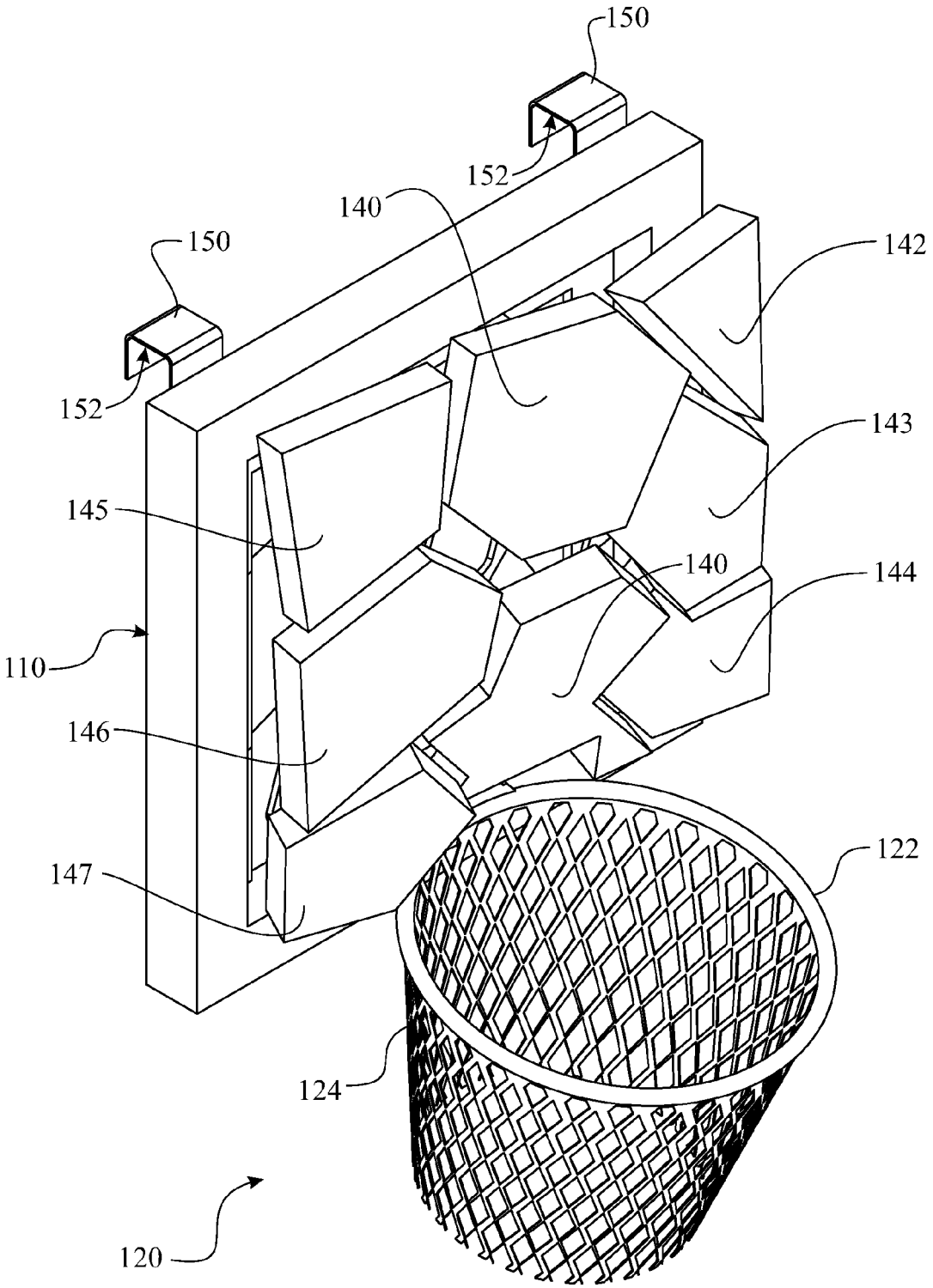
FIG. 7 presents an isometric view of the basketball hoop in a condition as previously illustrated in FIG. 5, showing initiation of the plurality of backboard pieces being projected outward to simulate a shattering of the backboard.

Turning now to FIGS. 5 through 8, there are shown front, side and isometric views, of the basketball hoop device 100 showing a slam dunk force applied to the hoop 122 to simulate the shattering of a basketball backboard, in accordance with the present invention. When a dunking force is applied to the hoop 122, such as the force of a person pushing a ball through the hoop 122 to mimic a slam-dunk, the hoop 122 swings or rotates to the downward position. The dunking force overcomes a retaining force applied by the second bias member 135, causing the hoop 122 to pivot accordingly. The pivotal motion of the hoop 122 forces the projector 132 to pivotally swing away from the rear panel 116 of the frame 110. With the presence of a sufficient amount of downward force, the projector 132 pivots beyond the distance defined by the gap 118 to contact and apply an ejection force to the rear surfaces of the plurality of backboard pieces 140-147, and abruptly projecting the backboard pieces 140-147 out from cavity 114 of frame 110. The motion of the abruptly projected backboard pieces 140-147 simulates the shattering of a glass backboard, as best illustrated in FIGS. 6 and 8. With the downward force removed, the spring mechanism 135 biases the hoop 122 into an upright position perpendicular to the rear panel 116 of frame 110 and returning the biasing projector 132 into a vertical orientation against the rear panel 116; i.e. returning the biasing projector 132 to the upright position, wherein the biasing projector 132 is parallel to the rear panel 116 of the frame 110. A user simply picks up the ejected backboard pieces 140-147 and repositions them within cavity 114 of frame 110. Each backboard piece 140-147 can be aligned according to the corresponding shape depicted on the rear panel 116.

It will be noted that the basketball hoop 100 of the present invention may include characters, or other indicia disposed on the outer surface of frame 110 as illustrated in FIG. 3. In one non-limiting example, words such as "Thunder" and "Dunker" may printed anywhere along the border of the frame 110. Further, the basketball hoop system 100 of the present invention may also include a locking mechanism used to selectively lock the hoop 122 in place thus preventing the projector 132 from engaging with the pieces 140-147 when a dunking force is applied to the hoop 122.

It is understood that the basketball hoop 100 may be provided in any reasonable size, based upon the desired application. The basketball hoop 100 can be provided in a smaller size for an indoor application, such as a desktop toy, a trash-can mounted apparatus, an interior wall mounted assembly, a door mounted configuration, and the like.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A basketball hoop system comprising:

a frame having a rear panel and a cavity extending inward from a front plane of said frame to said rear panel;

a plurality of backboard pieces detachably fitted together as a puzzle and releasably inserted within said cavity;

a hoop assembly comprising a circular hoop and netting suspended from said circular hoop; and a projector assembly comprising:

a support plate carried by said rear panel of said frame, a hoop supporting member carrying said hoop assembly and pivotally assembled to said support plate for undergoing pivotal movement relative thereto so as to dispose said circular hoop between an upright position relative to said frame in which said circular hoop extends perpendicular to said frame and a downward sloping position relative to said frame, a bias member coupled to and extending between said hoop supporting member and said support plate and biasing said hoop supporting member, and said circular hoop of said hoop assembly therewith, to move from said downward sloping position toward said upright position, and a projector comprising an elongated member coupled to said hoop supporting member so as to pivotally move therewith relative to said support plate such that said elongated member pivots between a staged configuration, wherein said elongated member is positioned separate from and unattached to said plurality of backboard pieces and extends within said cavity between said rear panel of said frame and a majority of said plurality of backboard pieces and behind said majority of said plurality of backboard pieces and adjacent to said rear panel of said frame when said circular hoop is in said upright position and said plurality of backboard pieces are releasably inserted within said cavity, and a deployed configuration, wherein said elongated member pivotally moves forward engaging said majority of said plurality of backboard pieces and ejecting said plurality of backboard pieces from said cavity of said frame when said circular hoop is drawn downward toward said downward sloping position.

2. The basketball hoop system as recited in claim 1, wherein each of said plurality of backboard pieces is fabricated of a soft pliant material.

3. The basketball hoop system as recited in claim 1, wherein each of said plurality of backboard pieces is fabricated of soft injection molded foam.

4. The basketball hoop system as recited in claim 1, wherein each of said plurality of backboard pieces comprises indicia disposed upon a surface of each of said plurality of backboard pieces, wherein said indicia provides an aid in the placement of said plurality of backboard pieces within said frame cavity.

5. The basketball hoop system as recited in claim 1, said rear panel further comprises:

a front surface, wherein said rear panel front surface is visibly exposed when said plurality of backboard pieces are removed from said cavity; and an outline of each of said plurality of backboard pieces is disposed upon said front surface, wherein said outline provides an aid in the placement of said plurality of backboard pieces within said frame cavity.

6. The basketball hoop system as recited in claim 1, wherein said bias member is a coil spring having one portion coupled to said hoop supporting member and a second portion coupled to said support plate.

7. The basketball hoop system as recited in claim 1, wherein said elongated member of said projector is a bar extending bilaterally from a central area of said frame, said elongated member defining a wing-shaped frame configured to extend behind said majority of said plurality of backboard pieces when said plurality of pieces are releasably fitted within said cavity.

8. The basketball hoop system as recited in claim 1, wherein said elongated member of said projector is a planar sheet of material having a size and shape to engage with said majority of said plurality of backboard pieces when said plurality of pieces are releasably positioned within said cavity.

9. The basketball hoop system as recited in claim 1, each of said plurality of backboard pieces further comprising a material disposed on at least a portion of a peripheral edge of said each backboard piece, wherein said material has a coefficient of friction that is greater than that of another surface of said backboard piece such that said material enhances a friction fit between each of said plurality of pieces.

10. A basketball hoop system comprising:

a frame having a rear panel and a cavity extending inward from a front plane of said frame to said rear panel;

a plurality of backboard pieces detachably fitted together as a puzzle and releasably fitted within said cavity;

a hoop assembly comprising a circular hoop and netting suspended from said circular hoop; and a projector assembly comprising:

a support plate attached to said rear panel of said frame, a hoop supporting member carrying said circular hoop of said hoop assembly and pivotally assembled to said support plate for undergoing pivotal movement relative thereto so as to move said circular hoop between an upright position relative to said frame and a downward sloping position relative to said frame, a pair of spaced apart spring mechanisms of a first bias member, said spring mechanisms being coupled to said hoop supporting member, a projector comprising an elongated member coupled to said spring mechanisms of said first bias member so as to pivotally move with said hoop supporting member relative to said support plate, wherein said elongated member of said projector is positioned separate from and unattached to said plurality of backboard pieces and extends within said cavity between said rear panel of said frame and a majority of said plurality of backboard pieces and behind said majority of said plurality of backboard pieces and adjacent to said rear panel of said frame when said plurality of pieces are releasably fitted within said cavity and said hoop supporting member disposes said circular hoop of said hoop assembly in said upright position, and a spring mechanism of a second bias member disposed between and spaced from said spaced apart spring mechanisms of said first bias member and being coupled to and extending between said hoop supporting member and said support plate so as to bias said hoop supporting member, and said circular hoop of said hoop assembly therewith, to move from said downward sloping position to said upright position.

11. The basketball hoop system as recited in claim 10, wherein said circular hoop when in said downward sloping position is at an obtuse angle relative to said frame and said elongated member of said projector is at an acute angle relative to said frame, and when in said upright position is perpendicular to said frame and said elongated member of said projector is parallel with said frame.

12. The basketball hoop system as recited in claim 10, further comprising a pair of inverted U-shaped brackets mounted proximate to each of a top corner of said frame defining an adequate space for hanging said basketball hoop system on a top edge of a door.

13. The basketball hoop system as recited in claim 10, wherein said spring mechanism of said second bias member is a coil spring having one portion coupled to said hoop supporting member and a second portion coupled to said support plate.

14. The basketball hoop system as recited in claim 10, wherein a front surface of said rear panel comprises an outline of each of said plurality of backboard pieces, said front surface being said front face of said rear panel that is visibly exposed when said plurality of backboard pieces are not within said cavity.

15. A basketball hoop system comprising:

a frame having a rear panel and a cavity extending inward from a front plane of said frame to said rear panel, said rear panel having a recess formed therein rearwardly of and in communication with said cavity;

a plurality of backboard pieces detachably fitted together as a puzzle and releasably fitted within said cavity forwardly of said recess in said rear panel;

a hoop assembly comprising a circular hoop and netting suspended from said circular hoop; and a projector assembly comprising:

a support plate disposed within said recess in said rear panel of said frame and attached to said rear panel, wherein said support plate is parallel to said rear panel and perpendicular to said circular hoop, a hoop supporting member carrying said circular hoop of said hoop assembly and pivotally assembled to said support plate for undergoing pivotal movement relative thereto so as to move said circular hoop between an upright position relative to said frame and a downward sloping position relative to said frame, a bias member coupled to and extending between said hoop supporting member and support plate and biasing said hoop supporting member, and said circular hoop of said hoop assembly therewith, to move from said downward sloping position toward said upright position, and a projector comprising an elongated member coupled to said hoop supporting member so as to pivotally move therewith relative to said support plate such that said elongated member pivots between a staged configuration, wherein said elongated member is positioned separate from and unattached to said plurality of backboard pieces and extends within said recess of said rear panel of said frame and is spaced rearwardly from a majority of said plurality of backboard pieces when said circular hoop is in said upright position and said plurality of backboard pieces are releasably inserted within said cavity so as to create a gap between said elongated member and said plurality of backboard pieces, and a deployed configuration, wherein said elongated member pivotally moves forward engaging said majority of said plurality of backboard pieces and ejecting said plurality of backboard pieces from said cavity of said frame when said circular hoop is drawn downward toward said downward sloping position, and also wherein said elongated member moves forward toward but stops short of ejecting said plurality of backboard pieces from said cavity of said frame when said circular hoop is moved only momentarily below said upright position.

16. The basketball hoop system as recited in claim 15, further comprising a pair of inverted U-shaped brackets mounted proximate to each of a top corner of said frame defining an adequate space for hanging said basketball hoop on a top edge of a door.

17. The basketball hoop system as recited in claim 15, wherein said bias member is a coil spring having one portion coupled to said hoop supporting member and a second portion coupled to said support plate.

18. The basketball hoop system as recited in claim 15, wherein said projector is a bar extending bilaterally from a central area of said frame, said projector defining a wing-shaped frame configured to extend behind said majority of said plurality of backboard pieces when said plurality of pieces are releasably fitted within said cavity.

19. The basketball hoop system as recited in claim 15, wherein a front surface of said rear panel comprises an outline of each of said plurality of backboard pieces, said front surface being said front face of said rear panel that is visibly exposed when said plurality of backboard pieces are not within said cavity.

* * * * *